US007364418B2

(12) United States Patent
Masuda et al.

(10) Patent No.: US 7,364,418 B2
(45) Date of Patent: Apr. 29, 2008

(54) SCROLL FLUID MACHINE HAVING AN ADJUSTMENT MEMBER WITH A DEFORMABLE ELEMENT

(75) Inventors: Masanori Masuda, Sakai (JP); Hirofumi Higashi, Sakai (JP); Katsumi Sakitani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/580,411

(22) PCT Filed: Nov. 29, 2004

(86) PCT No.: PCT/JP2004/017726

§ 371 (c)(1),
(2), (4) Date: May 24, 2006

(87) PCT Pub. No.: WO2005/059366

PCT Pub. Date: Jun. 30, 2005

(65) Prior Publication Data

US 2007/0104604 A1 May 10, 2007

(30) Foreign Application Priority Data

Nov. 28, 2003 (JP) ..... 2003-398642

(51) Int. Cl.
*F03C 2/00* (2006.01)
*F04C 2/00* (2006.01)

(52) U.S. Cl. ..... 418/142; 418/28; 418/55.1; 418/55.2; 418/55.4; 277/379; 277/399

(58) Field of Classification Search ..... 418/55.1–55.6, 418/57, 28, 142; 277/379, 399, 404, 411
See application file for complete search history.

(56) References Cited

U.S. PATENT DOCUMENTS

| | | | | | |
|---|---|---|---|---|---|
| 3,994,635 | A * | 11/1976 | McCullough | ..... | 418/55.4 |
| 4,395,205 | A * | 7/1983 | McCullough | ..... | 418/55.4 |
| 5,470,083 | A | 11/1995 | Rinne | | |
| 6,068,459 | A * | 5/2000 | Clarke et al. | ..... | 418/55.4 |
| 6,086,335 | A | 7/2000 | Bass et al. | | |
| 6,736,621 | B2 * | 5/2004 | Barito et al. | ..... | 418/55.2 |

FOREIGN PATENT DOCUMENTS

| | | | | | |
|---|---|---|---|---|---|
| EP | 0 124 114 | A2 | 11/1984 | | |
| JP | 57068580 | A * | 4/1982 | ..... | 418/6 |
| JP | 58-098687 | A | 6/1983 | | |
| JP | 63223379 | A * | 9/1988 | ..... | 418/55.2 |
| JP | 03-134287 | A | 6/1991 | | |
| JP | 07-97993 | A | 4/1995 | | |
| JP | 10-009161 | A | 1/1998 | | |

* cited by examiner

*Primary Examiner*—Theresa Trieu
(74) *Attorney, Agent, or Firm*—Global IP Counselors

(57) ABSTRACT

A scroll fluid machine includes a stationary scroll having a spiral wrap formed on an end plate and a moving scroll having a spiral wrap formed on an end plate. A polymer actuator for adjusting the amount of space between the wrap and the end plate is disposed in a recess formed at a tip of the wrap. The polymer actuator changes its shape along a height of the wrap to adjust an amount of the space. The polymer actuator also functions as a seal between the end plate and the wrap. The recess is formed such that a wall of the recess including an inner circumference surface of the wrap has a thickness different from that of a wall of the recess including an outer circumference surface of the wrap.

13 Claims, 7 Drawing Sheets

SCROLL FLUID MACHINE HAVING AN ADJUSTMENT MEMBER WITH A DEFORMABLE ELEMENT

CROSS-REFERENCE TO RELATED APPLICATIONS

This U.S. National stage application claims priority under 35 U.S.C. § 119(a) to Japanese Patent Application No. 2003-398642, filed in Japan on Nov. 28, 2003, the entire contents of which are hereby incorporated herein by reference.

TECHNICAL FIELD

The present invention relates to a scroll fluid machine, particularly to measures for controlling capacity.

BACKGROUND ART

Scroll compressors are conventionally incorporated in air conditioners. Having a fixed compression ratio, the scroll compressor is equipped with a power conditioning circuit such as an inverter to control the number of revolutions, thereby controlling the capacity.

However, the provision of the power conditioning circuit brings about a problem of a significant cost increase. Further, the power conditioning circuit consumes a large amount of power and the efficiency decreases due to power loss by the inverter.

In view of the above problem, Japanese Unexamined Patent Publication No. H10-9161 discloses a scroll fluid machine in which a bypass is formed in a stationary scroll so that compressed fluid returns to a low pressure chamber through the bypass.

PROBLEM THAT THE INVENTION IS TO SOLVE

The scroll fluid machine disclosed by Japanese Unexamined Patent Publication No. H10-9161 uses a piston valve mechanism. Therefore, the capacity is adjusted only in two stages and the control range is small. Further, power is required to operate the piston valve mechanism, thereby reducing the efficiency.

The present invention has been achieved in view of the above-described problems. An object of the present invention is to allow multistage control of the capacity and prevent the efficiency reduction.

MEANS OF SOLVING THE PROBLEM

SUMMARY OF THE INVENTION

The present invention is adapted to include a deformable element (40), such as a polymer actuator, which changes its shape according to external input.

Solution

Specifically shown in FIG. 3, a first aspect of the present invention is directed to a scroll fluid machine including at least a first scroll (21) having a spiral wrap (24) formed on an end plate (23) and a second scroll (22) having a spiral wrap (24) formed on an end plate (23). The scroll fluid machine further includes an adjustment member (4*a*) provided to adjust the amount of space between the wrap (24) of one of the scrolls (21 or 22) and the end plate (23) of the other scroll (22 or 21). The adjustment member (4*a*) includes a deformable element (40) which changes its shape according to external input.

According to a second aspect of the present invention related to the first aspect of the present invention, the deformable element (40) is formed at the tip of the wrap (24). The deformable element (40) changes its shape along the height of the wrap (24) to adjust the amount of the space.

According to a third aspect of the present invention related to the first aspect of the present invention, the deformable element (40) is formed at the tip of the wrap (24) to extend over the spiral of the wrap (24). The deformable element (40) changes its length along the spiral of the wrap (24) to adjust the amount of the space.

According to a fourth aspect of the present invention related to the third aspect of the present invention, two or more deformable elements (40) are formed along the spiral of the wrap (24).

According to a fifth aspect of the present invention related to the first aspect of the present invention, the deformable element (40) adjusts the amount of the space to vary a capacity.

According to a sixth aspect of the present invention related to the first aspect of the present invention, the deformable element (40) adjusts the amount of the space to vary an angle of rotation at which fluid discharge begins.

According to a seventh aspect of the present invention related to any one of the first to sixth aspects of the present invention, a working chamber (2*a*) is defined between the first scroll (21) and the second scroll (22) and a discharge port (2*b*) for discharging fluid from the working chamber (2*a*) is provided with a discharge valve. The wrap (24) is configured such that the capacity of the working chamber (2*a*) becomes substantially zero after the discharge is terminated.

According to an eighth aspect of the present invention related to the first aspect of the present invention, the deformable element (40) is provided at the tip of the wrap (24). The deformable element (40) also functions as a seal between the end plate (23) and the wrap (24).

According to a ninth aspect of the present invention related to the first aspect of the present invention, the deformable element (40) is disposed in a recess (25) formed at the tip of the wrap (24). The recess (25) is formed such that a wall of the recess (25) including an inner circumference surface of the wrap (24) has a thickness different from that of a wall of the recess (25) including an outer circumference surface of the wrap (24).

According to a tenth aspect of the present invention related to the first aspect of the present invention, the first scroll (21) is a stationary scroll and the second scroll (22) is a moving scroll. Only the first scroll (21) is provided with the deformable element (40).

According to an eleventh aspect of the present invention related to the first aspect of the present invention, the deformable element (40) is made of a polymer actuator.

Effect

According to the first aspect of the present invention, if the shape of the deformable element (40) is diminished from the maximum state, the amount of the space between the end plate (23) and the wrap (24) increases. As a result, the amount of fluid flowing from the working chamber (2*a*) to a low pressure region increases, thereby reducing the capacity.

Conversely, if the shape of the deformable element (40) is enlarged from the reduced state where the capacity has been reduced, the amount of the space between the end plate (23) and the wrap (24) decreases. As a result, the amount of fluid flowing from the working chamber (2*a*) to the low pressure region is reduced, thereby increasing the capacity.

According to the second aspect of the present invention, the deformable element (40) changes its shape along the height of the wrap (24) to adjust the amount of the space.

According to the third aspect of the present invention, the deformable element (24) changes its length along the spiral of the wrap (24) to adjust the amount of the space.

According to the fourth aspect of the present invention, two or more deformable elements (40) are formed along the spiral of the wrap (24) such that they change their shapes along the spiral of the wrap (24). Accordingly, gaps between the deformable elements (40) are adjusted to adjust the amount of the space.

According to the fifth aspect of the present invention, the capacity is varied in response to the change in shape of the deformable element (40).

According to the sixth aspect of the present invention, an angle of rotation at which fluid discharge begins is varied in response to the change in shape of the deformable element (40).

According to the seventh aspect of the present invention, the capacity of the working chamber (2*a*) becomes substantially zero after the discharge is terminated. Therefore, the compression ratio is prevented from reduction.

According to the eighth aspect of the present invention, the deformable element (40) also functions as a seal between the end plate (23) and the wrap (24). Therefore, the number of components is reduced.

According to the ninth aspect of the present invention, an inner wall of the recess (25) including the inner circumference surface of the wrap (24) has a thickness different from that of an outer wall of the recess (25) including the outer circumference surface of the wrap (24). Therefore, the strength of the wrap (24) is maintained and the amount of fluid leakage is reduced.

According to the tenth aspect of the present invention, only the stationary scroll (21) is provided with the deformable element (40). Therefore, power supply is easily carried out.

According to the eleventh aspect of the present invention, the deformable element (40) is made of the polymer actuator (40). Therefore, the amount of the space is adjusted with reliability.

EFFECT OF THE INVENTION

According to the present invention, the deformable element (40) is provided at the tip of the wrap (24) to adjust the amount of the space between the wrap (24) and the end plate (23). Therefore, capacity control is easily achieved. Especially, multistage capacity control is achieved because the amount of the space can be varied within a wide range.

Further, as the capacity control is achieved by merely changing the shape of the deformable element (40), the power required is small. Thus, an improvement in efficiency is expected.

According to the fourth aspect of the present invention, two or more deformable elements (40) are provided. Therefore, the capacity control is carried out with accuracy.

According to the fifth aspect of the present invention, the deformable element (40) adjusts the amount of the space to vary the capacity. Therefore, the capacity is controlled with reliability.

According to the sixth aspect of the present invention, the deformable element (40) at the beginning of the spiral of the wrap (24) increases the amount of the space to adjust an angle of rotation at which fluid discharge begins. Therefore, the compression ratio is controlled.

According to the seventh aspect of the present invention, the wrap (24) is configured such that the capacity of the working chamber (2*a*) becomes substantially zero after the discharge is terminated. For example, if the capacity of the closed working chamber is reduced, the compression ratio is reduced. However, if a discharge pressure which is generally high is raised to a further degree, the compression ratio is prevented from reduction.

According to the eighth aspect of the present invention, the deformable element (40) also functions as a seal between the end plate (23) and the wrap (24). Therefore, the number of components is reduced.

According to the ninth aspect of the present invention, the deformable element (40) is shifted inside from the widthwise center of the wrap. Therefore, an inner wall (2*c*) of the recess (25) including the inner circumference surface of the wrap (24) has a thickness smaller than that of an outer wall (2*d*) of the recess (25) including the outer circumference surface of the wrap (24). As the inside of the wrap (24) is applied with higher pressure than the outside thereof, certain strength is maintained by the thick outer wall (2*d*). Further, as the inner wall (2*c*) is made thin, fluid leakage in the tangential direction is reduced.

According to the tenth aspect of the present invention, only the stationary scroll (21) is provided with the deformable element (40). Therefore, the structure for power supply is simplified.

According to the eleventh aspect of the present invention, the deformable element (40) is made of the polymer actuator (40). Therefore, the amount of the space is adjusted with reliability.

BEST MODE FOR CARRYING OUT THE INVENTION

Figure 1:
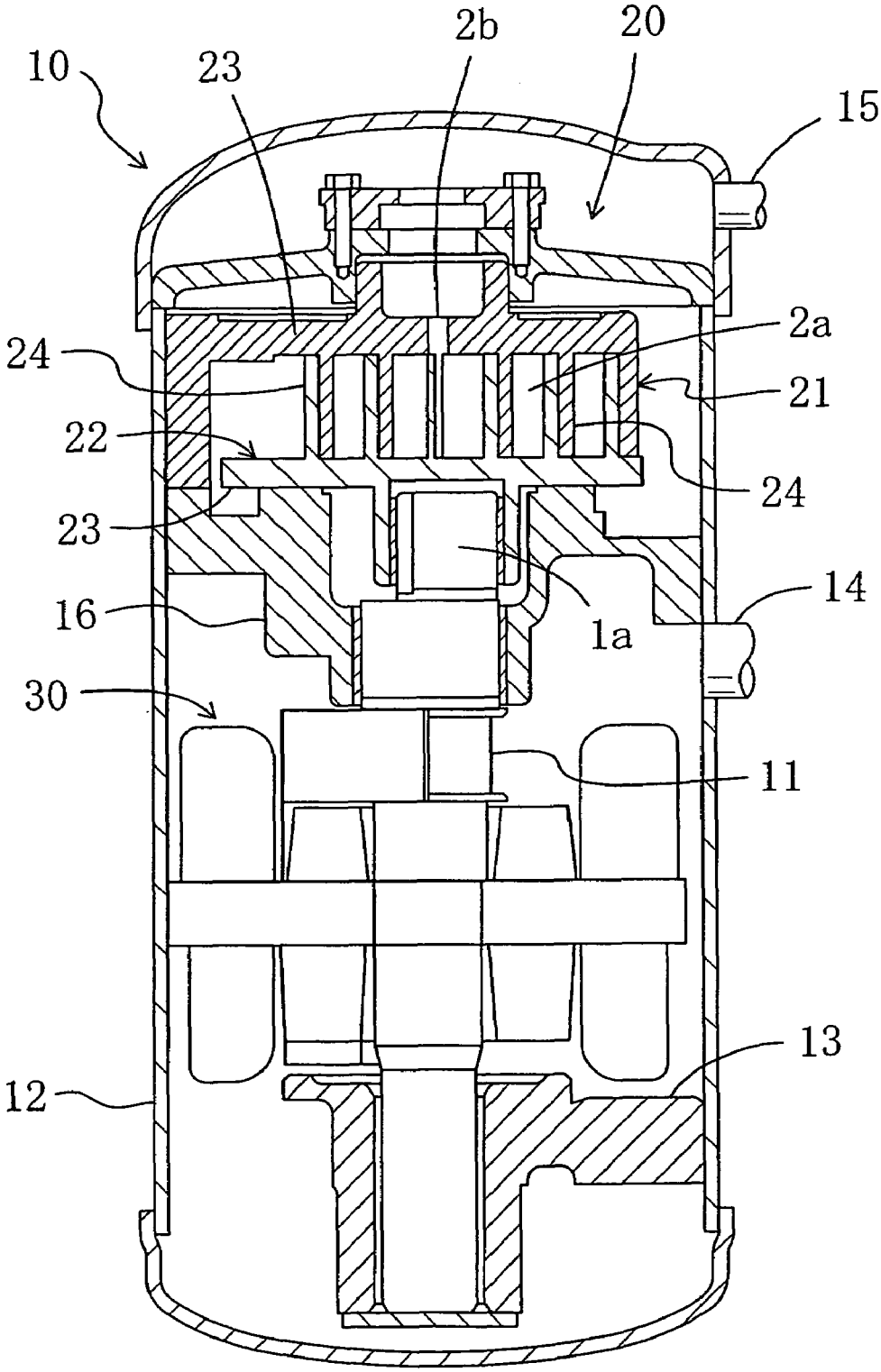
FIG. 1 is a vertical section illustrating a scroll compressor according to a first embodiment.
Figure 2A:
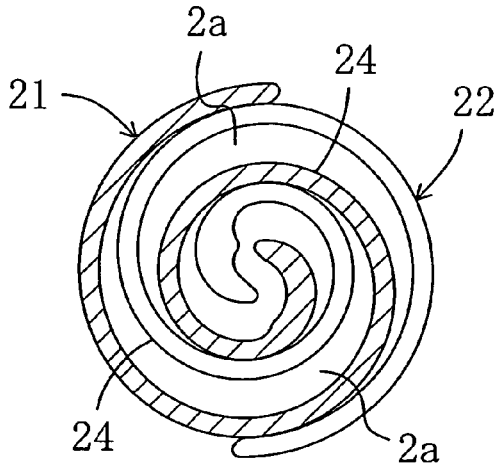
FIGS. 2A to 2D are horizontal sections of a major part illustrating how the compression is carried out according to the first embodiment.
Figure 2D:
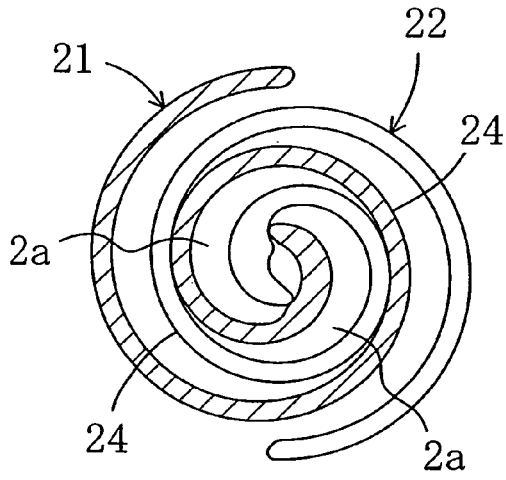
Figure 2B:
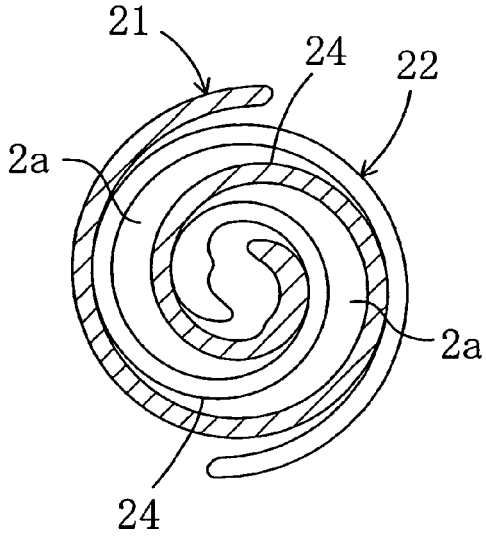
Figure 2C:
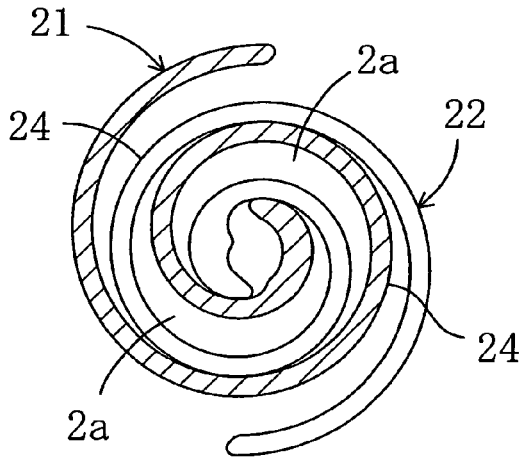

Hereinafter, a detailed explanation of embodiments of the present invention will be provided with reference to the drawings.

First Embodiment

As shown in FIGS. 1 and 2A to 2D, a scroll fluid machine of the present embodiment is a scroll compressor (10). The scroll compressor (10) includes a compressor mechanism (20), a motor (30) and a drive shaft (11). The scroll compressor (10) is incorporated in a refrigerant circuit such as an air conditioner to compress refrigerant gas.

The motor (30) is connected to the compressor mechanism (20) via the drive shaft (11). The compressor mechanism (20) and the motor (30) are hermetically disposed in a cylindrical casing (12). The scroll compressor (10) is vertically oriented. The compressor mechanism (20) is positioned at an upper part of the inside space of the casing (12) and a bottom bearing (13) is positioned at a lower part of the inside space of the casing (12). The motor (30) is arranged between the compressor mechanism (20) and the bottom bearing (13).

The casing (12) further includes a suction pipe (14) provided between the compressor mechanism (20) and the motor (30) to pass the refrigerant therethrough. A discharge pipe (15) is provided at the head part of the casing (12) above the compressor mechanism (20) to pass the compressed refrigerant.

The compressor mechanism (20) includes a stationary scroll (21) as a first scroll, a moving scroll (22) as a second scroll and a bearing (16).

Each of the stationary scroll (21) and the moving scroll (22) includes an end plate (23) and a spiral wrap (24) formed thereon. The stationary scroll (21) and the moving scroll (22) are arranged such that their wraps (24) are engaged with each other. With the wraps (24) of the scrolls (21, 22) engaged as described above, a compressor chamber (2*a*) as a working chamber is defined by the wraps (24) and the end plates (23). The wrap (24) of the stationary scroll (21) and the wrap (24) of the moving scroll (22) have the same spiral length.

The stationary scroll (21) is fixed to the bearing (16) and the moving scroll (22) is mounted on the bearing (16) via an Oldham ring. An eccentric part (1*a*) which is formed on the drive shaft (11) is connected to the rear side of the moving scroll (22).

Figure 3:
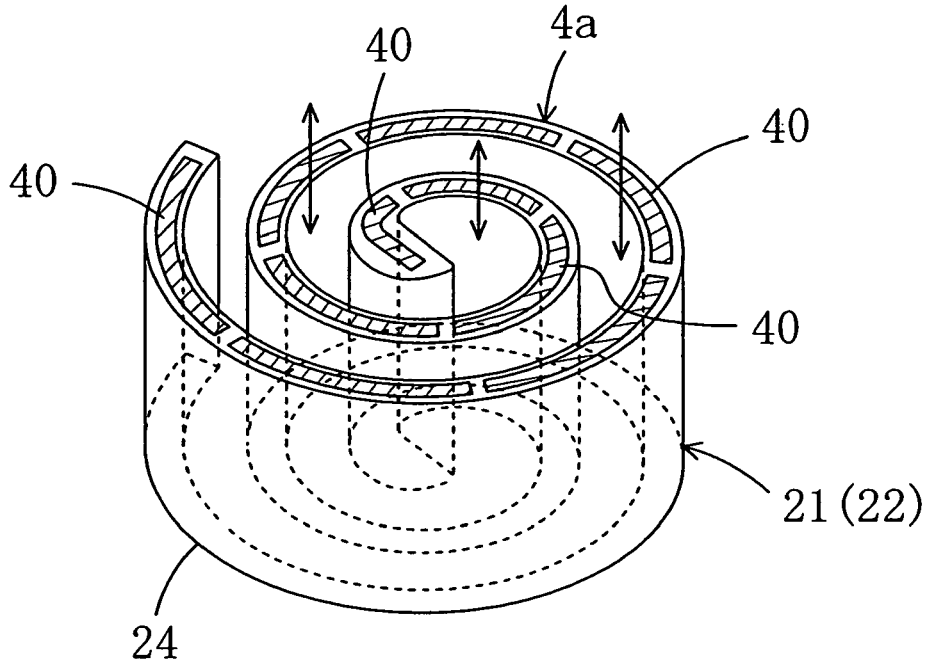
FIG. 3 is an oblique view illustrating a stationary scroll and a moving scroll according to the first embodiment.

Further, as a characteristic feature of the present invention, adjustment members (4*a*) for adjusting the amount of space are provided at each of the tips of the wraps (24) of the stationary scroll (21) and the moving scroll (22) as shown in FIG. 3.

Figure 4:
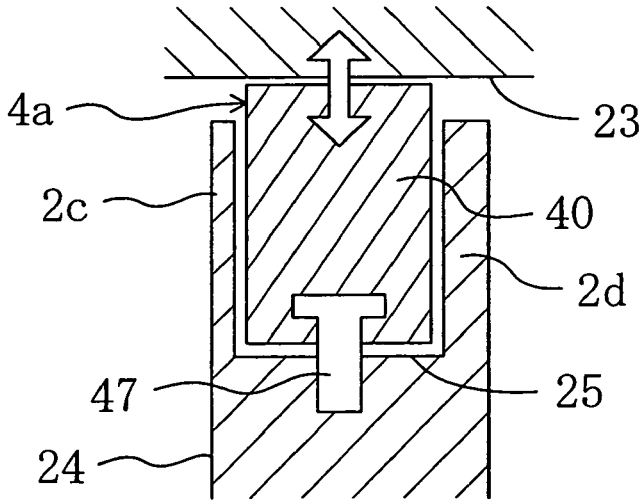
FIG. 4 is an enlarged vertical section of a major part illustrating a polymer actuator according to the first embodiment.

As shown in FIGS. 3 and 4, the adjustment members (4*a*) include polymer actuators (40), respectively, for adjusting the amount of the space between the wrap (24) of the stationary scroll (21) and the end plate (23) of the moving scroll (22) and the amount of the space between the wrap (24) of the moving scroll (22) and the end plate (23) of the stationary scroll (21). That is, the polymer actuators (40) function as deformable elements (40) which change their shapes according to external input, such as voltage.

Figure 5:
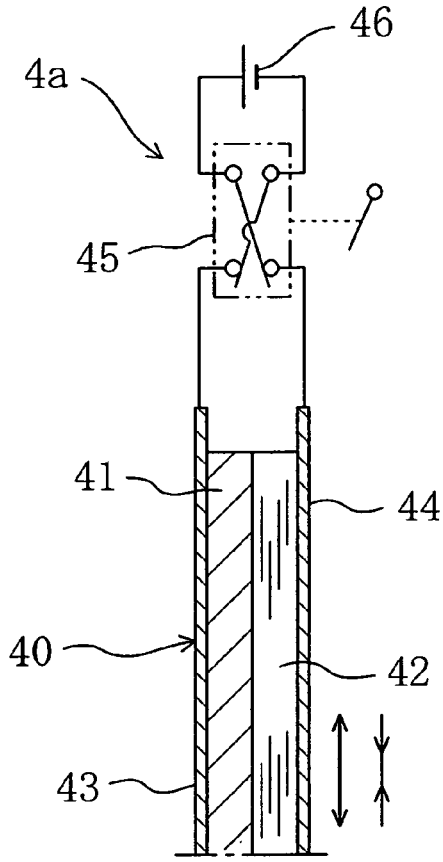
FIG. 5 is a view of a major part illustrating the structure of the polymer actuator according to the first embodiment.

Each of the polymer actuators (40) is a conductive polymer actuator made of a conductive polymer element as shown in FIG. 5.

The polymer actuator (40) made of the conductive polymer element is capable of expanding and contracting according to voltage application. For example, the polymer actuator (40) includes a polymer substance (41) such as polyaniline, an electrolyte (42) arranged in contact with the polymer substance (41), an electrode (43) provided at the outside of the polymer substance (41) and an electrode (44) provided at the outside of the electrolyte (42). The outer sides of the electrodes (43, 44) are covered with a protection coating such as a resin film, respectively. The electrodes (43, 44) are connected to a DC power supply (46) via a transfer switch (45). The electrodes (43, 44) of the polymer actuator (40) change their polarities as needed in response to the operation of the transfer switch (45), whereby the polymer actuator (40) expands or contracts as indicated by arrows in FIG. 3.

Specifically, if the electrode (43) is made positive and the electrode (44) is made negative, anions in the electrolyte (42) are taken into the polymer substance (41). As a result, the polymer substance (41) swells to expand. Conversely, when the electrode (43) is made negative and the electrode (44) is made positive, the anions taken by the polymer substance (41) are released into the electrolyte (42) to shrink the polymer substance (41). In this way, the polymer actuator (40) expands or contracts by changing the polarities of the voltages applied to the electrodes.

After expanded or contracted by voltage application, the polymer actuator (40) remains expanded or contracted even if the voltage is no longer applied thereto. That is, the polymer actuator (40) is applied with voltage only when the expansion or contraction is required. This characteristic is completely different from that of a shape-memory alloy which must be kept heated to maintain the regained shape.

As shown in FIG. 4, the polymer actuators (40) are disposed in recesses (25) formed at the tip of the wrap (24). The recesses (25) are formed from the beginning to the end of the spiral of the wrap (24). Each of the polymer actuators (40) disposed in the recesses (25) is fixed to the wrap (24) at the bottom thereof by a pin (47). The polymer actuators (40) provided from the beginning to the end of the spiral of the wrap (24) protrude upward from the recesses (25). The polymer actuators (40) are arranged to contact the end plate (23) at the top faces thereof to function as a seal between the end plate (23) and the wrap (24).

Each of the polymer actuators (40) changes its shape along the height of the wrap (24) to vary the amount of the space between the end plate (23) and the wrap (24). Specifically, if the amount of the space is increased by the polymer actuator (40), part of the refrigerant in the compressor chamber (2*a*) flows into a low pressure region in the casing (12) to reduce the capacity of the compressor mechanism (20). On the other hand, if the amount of the space is reduced by the polymer actuator (20), the amount of the refrigerant flowing from the compressor chamber (2*a*) to the low pressure region in the casing (12) is reduced, thereby increasing the capacity of the compressor chamber (20). In particular, if the amount of the space is linearly increased or decreased by the polymer actuator (40), the capacity of the compressor chamber (20) is also varied linearly.

Thus, the polymer actuators (40) adjust the amount of the refrigerant flowing to the low pressure region to control the compression capacity.

One of the polymer actuators (40) positioned at the beginning of the spiral of the wrap (24) adjusts the amount of the space to vary an angle of rotation at which the discharge begins. Specifically, the beginning of the spiral of the wrap (24) determines an angle of rotation at which the compressor chamber (2*a*) communicates with a discharge port (2*b*). Therefore, if the polymer actuator (40) at the beginning of the spiral increases the amount of the space, the angle of rotation at which the discharge begins is varied. In particular, if the polymer actuator (40) at the beginning of the spiral is configured such that it changes the shape along the spiral of the wrap (24), the angle of rotation at which the discharge begins is linearly varied.

One of the polymer actuators (40) positioned at the end of the spiral of the wrap (24) adjusts the amount of the space to vary the capacity of the closed chamber. Specifically, the end of the spiral of the wrap (24) determines the position of the compressor chamber (2*a*). Therefore, if the polymer actuator (40) at the end of the spiral increases the amount of the space, the capacity of the closed chamber is varied. In particular, if the polymer actuator (40) at the end of the spiral is configured such that it changes the shape along the spiral of the wrap (24), the capacity of the closed chamber is linearly varied.

The recesses (25) formed at the tip of the wrap (24) are positioned more inside than the widthwise center of the wrap (24). Specifically, each of the recesses (25) is arranged such that an inner wall (2*c*) of the recess (25) including the inner circumference surface of the wrap (24) is smaller in thickness than an outer wall (2*d*) of the recess (25) including the outer circumference surface of the wrap (24). Space inside the wrap (24) is applied with a higher pressure than that applied to the outside of the wrap (24). For this reason, the outer wall (2*d*) is made thick to maintain certain strength and the inner wall (2*c*) is made thin to reduce refrigerant leakage in the tangential direction.

A means for supplying power to the polymer actuators (40) of the stationary scroll (21) may be wires buried in the end plate (23) or other components such that power is supplied to the polymer actuators (40) via the wires.

Though not shown, a power supply means for the polymer actuators (40) of the moving scroll (22) may be a non-contact system including a primary coil and a secondary coil or slidable electrodes. A break is prevented with use of the power supply means.

Operation

Subsequently, an explanation of how the hermetic compressor (10) works will be provided.

When the motor (30) is driven, the drive shaft (11) is rotated to revolve the moving scroll (22) about the stationary scroll (21) without spinning by itself. Accordingly, the refrigerant flowing in the suction pipe (14) is sucked into the compressor chamber (2*a*) of the compressor mechanism (20). As the moving scroll (22) revolves, the compressor chamber (2*a*) decreases in capacity as it moves to the center, thereby compressing the sucked refrigerant.

The refrigerant is compressed as the capacity of the compressor chamber (2*a*) varies. Then, the high-pressured refrigerant is discharged to the inside of the casing (12) through the discharge port (2*b*) formed almost in the middle of the stationary scroll (21). The discharged refrigerant is sent to a refrigerant circuit through the discharge pipe (15), subjected to condensation, expansion and evaporation in the refrigerant circuit and then sucked again by the suction pipe (14) for compression.

If all the polymer actuators (40) reach the maximum height during the compression of the refrigerant, the compression capacity is maximized. If the height of the polymer actuators (40) is reduced from the maximum level at which the compression capacity is at the maximum, the amount of the space between the end plate (23) and the polymer actuators (40) increases. As a result, the amount of the refrigerant flowing from the compressor chamber (2*a*) to the low pressure region in the casing (12) increases and the capacity of the compressor mechanism (20) decreases.

Conversely, if the height of the polymer actuators (40) is increased from the reduced level at which the compression capacity is reduced, the amount of the space between the end plate (23) and the polymer actuators (40) is reduced. As a result, the amount of the refrigerant flowing from the compressor chamber (2*a*) to the low pressure region in the casing (12) decreases and the capacity of the compressor mechanism (20) increases.

If the polymer actuators (40) linearly increase or decrease the amount of the space, the capacity of the compressor mechanism (20) is also varied linearly.

If the polymer actuator (40) at the beginning of the spiral increases the amount of the space, the angle of rotation at which the discharge begins becomes small. Accordingly, the compression ratio is reduced.

Further, if the polymer actuator (40) at the end of the spiral increases the amount of the space, the capacity of the closed chamber becomes small. Accordingly, the compression ratio is reduced.

Effect of the First Embodiment

According to the present embodiment, the polymer actuators (40) are provided at the tip of the wrap (24) to adjust the amount of the space between the wrap (24) and the end plate (23), thereby controlling the capacity of the compressor mechanism (20). In particular, as the amount of the space is adjusted within a wide range, the capacity of the compressor mechanism (20) is easily controlled in a multistage manner.

As the capacity of the compressor mechanism (20) is controlled by merely changing the shape of the polymer actuators (40), the power required is small. Therefore, an improvement in efficiency is expected.

In particular, the polymer actuators (40) adjust the amount of the space to vary the capacity. Therefore, the capacity control is carried out with reliability.

If the polymer actuator (40) at the beginning of the spiral increases the amount of the space, the angle of rotation at which the discharge begins becomes small, thereby reducing the compression ratio. Thus, the compression ratio is controlled.

If the polymer actuator (40) at the end of the spiral increases the amount of the space, the capacity of the closed chamber becomes small, thereby reducing the compression ratio. Thus, the compression ratio is controlled.

Further, each of the polymer actuators (40) is shifted inside from the widthwise center of the wrap (24). Accordingly, the inner wall (2*c*) of the recess (25) including the inner circumference surface of the wrap (24) is smaller in thickness than the outer wall (2*d*) of the recess (25) including the outer circumference surface of the wrap (24). As the space inside the wrap (24) is applied with a higher pressure than that applied to the outside of the wrap (24), the outer wall (2*d*) is made thick to maintain certain strength and the inner wall (2*c*) is made thin to reduce refrigerant leakage in the tangential direction.

Further, as the polymer actuators (40) also function as a seal between the end plate (23) and the wrap (24), the number of components is reduced.

Second Embodiment

Hereinafter, a detailed explanation of the second embodiment will be provided with reference to FIG. 6.

Different from the polymer actuators (40) of the first embodiment which are configured to change their shapes along the height, the polymer actuators (40) of the present embodiment change their shapes in the circumferential direction.

Figure 6:
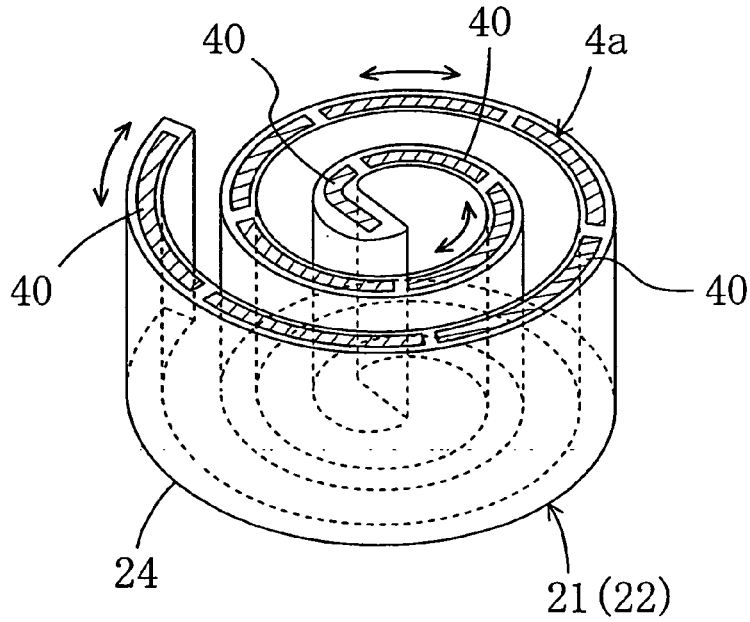
FIG. 6 is an enlarged vertical section of a major part illustrating a polymer actuator according to a second embodiment.

Specifically, as indicated by the arrows in FIG. 6, the polymer actuators (40) are configured to change their shapes along the spiral of the wrap (24).

If all the polymer actuators (40) reach the maximum length during the compression of the refrigerant, gaps between the polymer actuators (40) are minimized, thereby maximizing the compression capacity. If the length of the polymer actuators (40) is reduced from the maximum level at which the capacity is at the maximum, the gaps between the polymer actuators (40) increase, thereby increasing the amount of the space between the end plate (23) and the wrap (24). As a result, the amount of the refrigerant flowing from the compressor chamber (2*a*) to the low pressure region in the casing (12) increases and the capacity of the compressor mechanism (20) decreases.

Conversely, if the length of the polymer actuators (40) is increased from the reduced level at which the compressor capacity is reduced, the amount of the space between the end plate (23) and the wrap (24) decreases. As a result, the amount of the refrigerant flowing from the compression chamber (2*a*) to the low pressure region of the casing (12) decreases and the capacity of the compressor mechanism (20) increases.

If the polymer actuators (40) linearly increase or decrease their lengths, the capacity of the compressor mechanism (20) is also varied linearly.

If the length of the polymer actuator (40) at the beginning of the spiral is reduced to increase the amount of the space, the angle of rotation at which the discharge begins becomes small. Accordingly, the compression ratio is reduced.

Further, if the length of the polymer actuator (40) at the end of the spiral is reduced to increase the amount of the space, the capacity of the closed chamber becomes small. Accordingly, the compression ratio is reduced.

In particular, as the two or more polymer actuators (40) are provided, the capacity control is carried out with accuracy. Other components and the effect of the present embodiment are the same as those of the first embodiment.

The polymer actuators (40) of the second embodiment may be replaced with a single polymer actuator (40). Specifically, a single polymer actuator (40) ranging from the beginning to the end of the spiral of the wrap (24) may be formed. If the length of this polymer actuator (40) is reduced, the amount of the space increases at either one of the beginning and the end of the wrap (24). Further, if a middle part of the polymer actuator (40) is fixed, the amount of the space can be adjusted at both of the beginning and the end of the wrap (24) to control the capacity of the compressor mechanism (20).

Third Embodiment

Figure 7:
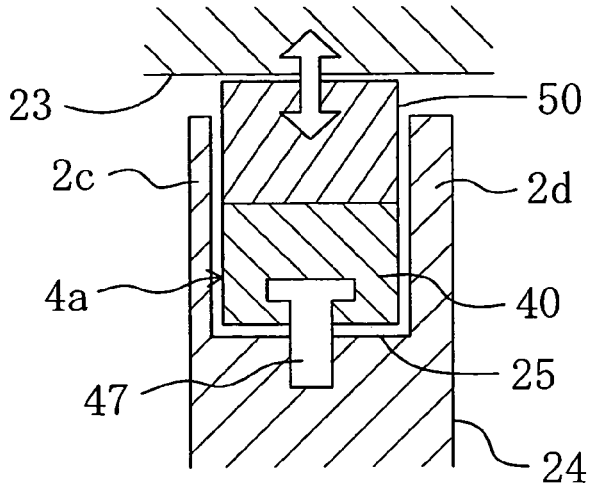
FIG. 7 is an enlarged vertical section of a major part illustrating a polymer actuator according to a third embodiment.

A detailed explanation of a third embodiment of the present invention will be provided with reference to FIG. 7.

Different from the polymer actuator (40) of the first embodiment which also functions as a seal, the polymer actuator (40) of the present embodiment is separated from the seal.

Specifically, a sealing element (50) is provided on each of the polymer actuators (40) such that the sealing element (50) contacts the end plate (23).

According to the structure, the wrap (24) and the end plate (23) are sealed with reliability and damage to the polymer actuators (40) is surely prevented.

Other components and the effect of the present embodiment are the same as those of the first embodiment.

Fourth Embodiment

Figure 8:
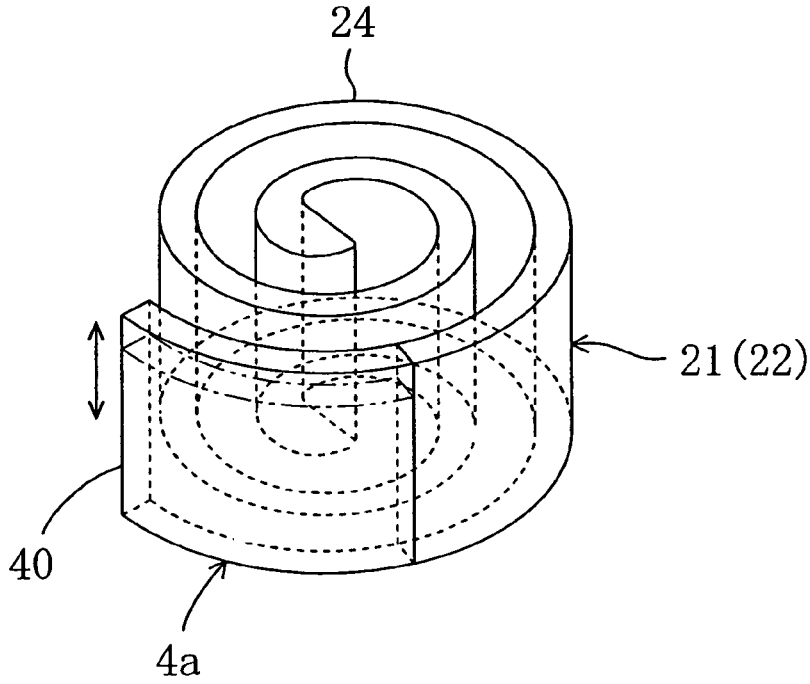
FIG. 8 is an enlarged vertical section of a major part illustrating a polymer actuator according to a fourth embodiment.

A detailed explanation of a fourth embodiment of the present invention will be provided with reference to FIG. 8.

Different from the polymer actuator (40) of the first embodiment which also functions as a seal, the polymer actuator (40) of the present embodiment ranges from the top to the bottom of the wrap (24).

For example, as shown in FIG. 8, the polymer actuator (40) ranging from the top to the bottom of the wrap (24) is formed at the end of the spiral of the wrap (24). The polymer actuator (40) changes the shape along the height of the wrap as indicated by an arrow in FIG. 8 to adjust the amount of the space.

Other components and the effect of the present embodiment are the same as those of the first embodiment.

Fifth Embodiment

A detailed explanation of a fifth embodiment of the present invention will be provided with reference to FIG. 9.

Different from the polymer actuator (40) of the fourth embodiment which changes the shape along the height, the polymer actuator (40) of the present embodiment is configured to be bendable.

Figures 9A, 9B, 9C:
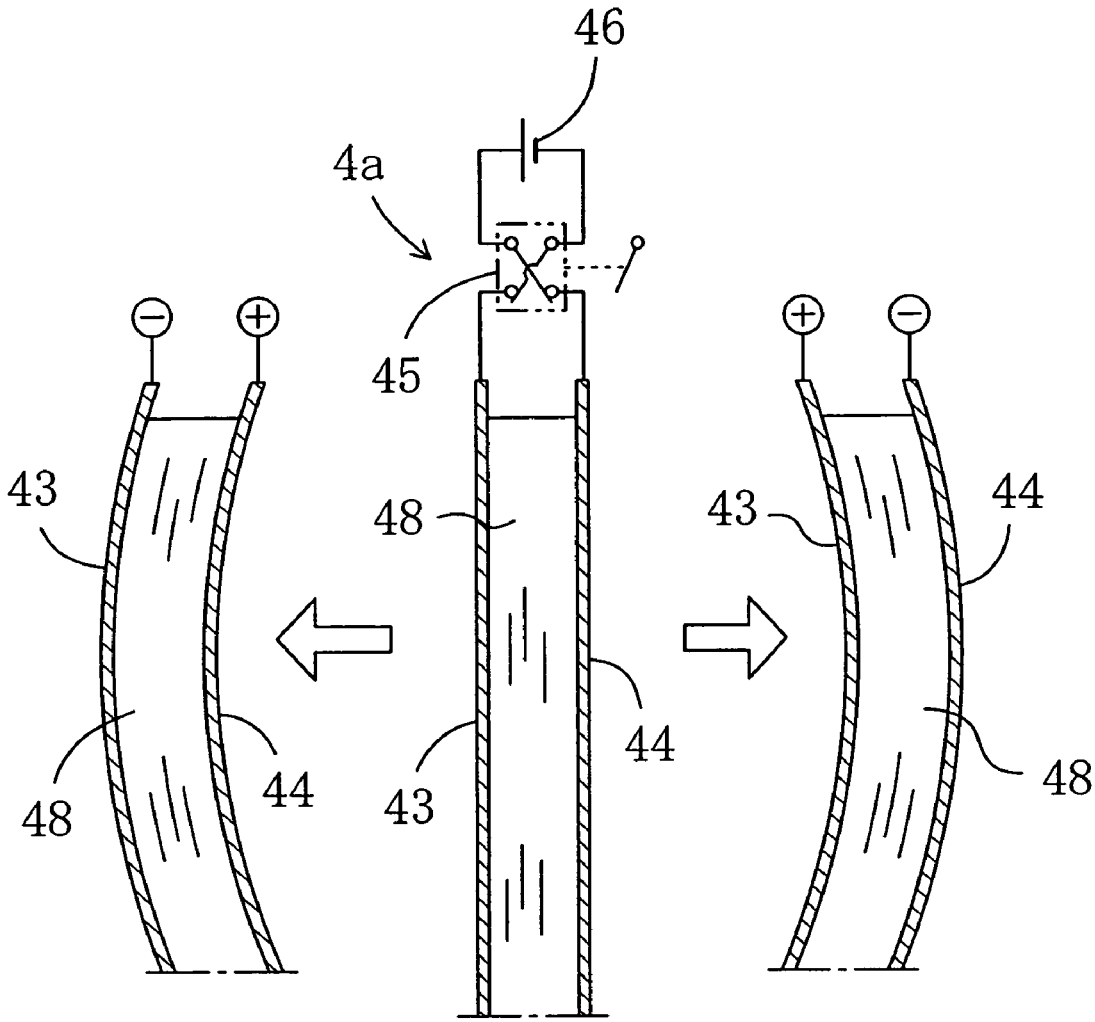
FIGS. 9A to 9C are views of a major part illustrating the structure of a polymer actuator according to a fifth embodiment.
Figure 10A:
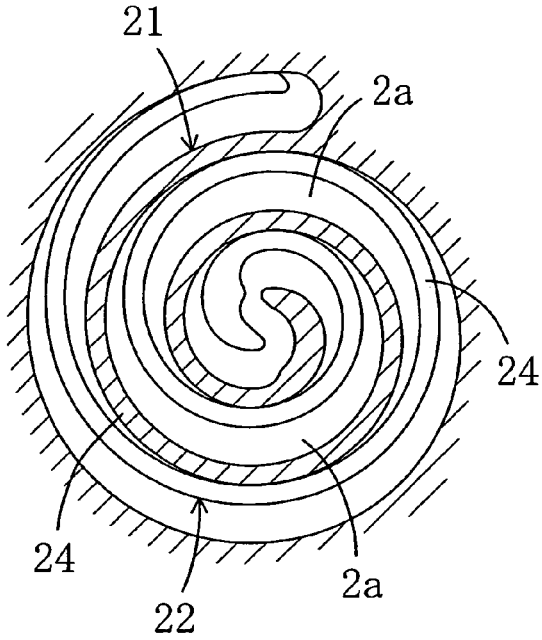
FIGS. 10A to 10D are horizontal sections of a major part illustrating how the compression is carried out according to a sixth embodiment.
Figure 10D:
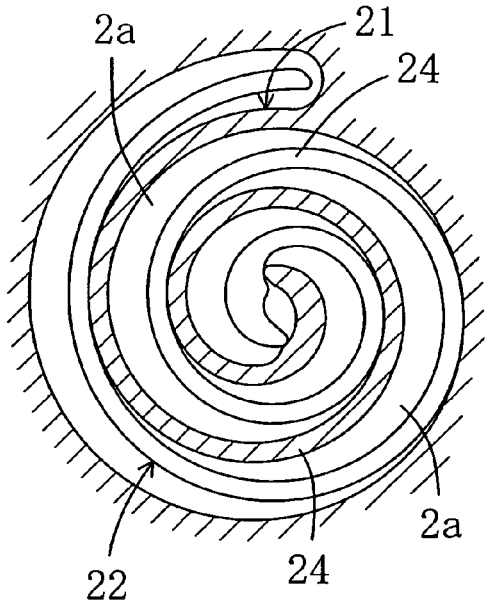
Figure 10B:
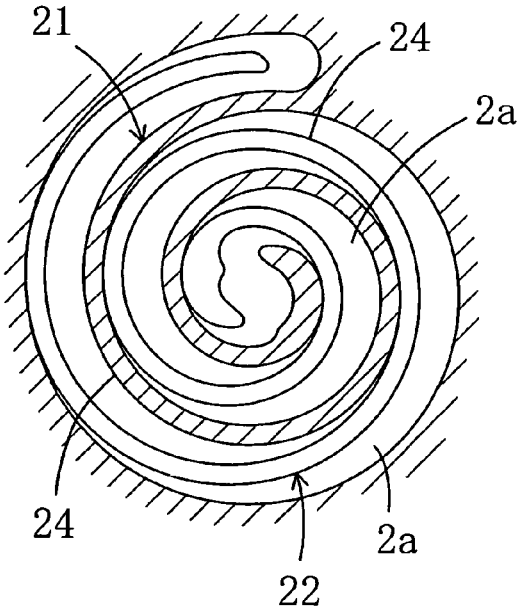
Figure 10C:
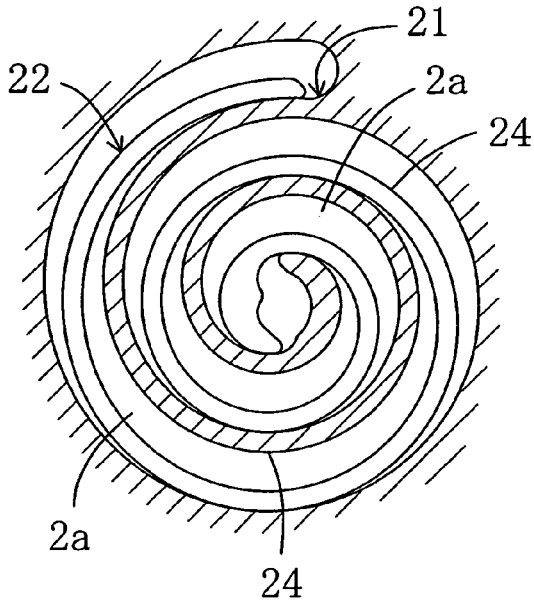

Specifically, the polymer actuator (40) is made of an ion conductive actuator. The ion conductive polymer actuator (40) has a property of bending according to voltage application. As shown in FIG. 9A, the polymer actuator (40) includes electrodes (43, 44) which are attached to both sides of a hydrated electrolyte (48), respectively. The outer sides of the electrodes (43, 44) are covered with a protection coating such as a resin film, respectively. The electrodes (43, 44) are connected to a DC power supply (46) via a transfer switch (45). The polymer actuator (40) bends in response to a change in polarity of the electrodes (43, 44) by the operation of the transfer switch (45).

As shown in FIG. 9B, if the electrode (43) is made positive and the electrode (44) is made negative, cations in the hydrated electrolyte (48) move toward the negative electrode together with water. Accordingly, the moisture content increases in part of the electrolyte close to the negative electrode to cause a difference in the degree of swelling between the negative electrode side and the positive electrode side. As a result, the polymer actuator (40) bends to protrude toward the negative electrode, i.e., the electrode (44). On the other hand, if the electrode (43) is made negative and the electrode (44) is made positive as shown in FIG. 9C, the cations in the hydrated electrolyte (48) move toward the negative electrode together with water. As a result, the polymer actuator (40) bends to protrude toward the negative electrode, i.e., the electrode (43). In this way, the polymer actuator (40) bends in response to a change in polarity of the voltage to be applied.

Therefore, for example, if the polymer actuator (40) at the end of the spiral of the wrap (24) shown in FIG. 8 bends, the capacity of the closed chamber varies to control the capacity.

Other components and the effect of the present embodiment are the same as those of the fourth embodiment.

Sixth Embodiment

A detailed explanation of a sixth embodiment of the present invention will be provided with reference to FIG. 10.

Different from the wraps (24) of the stationary scroll (21) and the moving scroll (22) of the first embodiment having the same length, the wraps (24) of the present embodiment are configured to be asymmetric.

Specifically, the wrap (24) of the moving scroll (22) is formed longer than that of the stationary scroll (21) by almost 180° turn of the spiral. As a result, two compressor chambers (2*a*) having different capacities are defined. Also in the present embodiment, the polymer actuator (40) is formed at the tip of the wrap (24).

Other components and the effect of the present embodiment are the same as those of the first embodiment.

Other Embodiments

The first embodiment of the present invention may be modified as follows.

(a) The above-described embodiments are directed to the scroll compressor (10). However, the present invention may be applied to other scroll compressors (10) having different structures, as well as expansion mechanisms. Any scroll fluid machine can be covered by the present invention as long as the polymer actuator (40) is provided to control the capacity of the working chamber (2*a*).

(b) The above-described embodiments refer to a scroll fluid machine including a combination of a single stationary scroll (21) and a single moving scroll (22). According to the present invention, however, the scroll fluid machine may include two or more stationary scrolls (21) and two or more moving scrolls (22). For example, the wraps (24) may be formed on both sides of the end plate (23) of the moving scroll (22) and two stationary scrolls (21) may be provided to engage with the wraps (24), respectively.

(c) In the above-described embodiments, the polymer actuator (40) is an ion conductive actuator or a conductive polymer actuator made of a conductive polymer element. However, needless to say, any one of these actuators may be used as the polymer actuator (40) of the present invention.

(d) In the above-described embodiments, the polymer actuator (40) is used as a deformable element. However, any kind of actuators may be used in the present invention as long as they are capable of changing their shapes according to external input such as voltage application.

(e) In the above-described embodiments, one or more polymer actuators (40) are formed from the beginning to the end of the spiral of the wrap (24). However, the polymer actuator (40) may be formed only at the beginning or the end of the spiral of the wrap (24) as shown in FIG. 8. The polymer actuator (40) may be formed in any way as long as it is able to control the capacity.

(f) In the above-described embodiments, the polymer actuator (40) is provided in both of the stationary scroll (21) and the moving scroll (22). However, the polymer actuator (40) may be provided only in the stationary scroll (21). Specifically, the deformable element (40) is disposed only in the stationary scroll (21) to adjust the space between the wrap (24) of the stationary scroll (21) and the end plate (23) of the moving scroll (22). In this case, the structure for power supply is easily provided.

(g) In the above-described embodiments, the discharge port (2*b*) is configured to be always open. However, a discharge valve may be formed. Further, the wrap (24) may be configured such that the capacity of the compressor chamber (2*a*) as a working chamber becomes substantially zero after the discharge is terminated. For example, if the capacity of the closed compressor chamber (2*a*) is reduced, the compression ratio decreases. However, if the discharge pressure which is generally high is raised to a further degree, the compression ratio is prevented from reduction.

INDUSTRIAL APPLICABILITY

As described above, the present invention is useful for a scroll fluid machine for controlling capacity.

What is claimed is:

1. A scroll fluid machine comprising:

at least one first scroll having a spiral wrap formed on an end plate, the first scroll being a stationary scroll;

at least one second scroll having a spiral wrap formed on an end plate, the second scroll being a moving scroll; and an adjustment member provided to adjust an amount of a space between the wrap of one of the first and second scrolls and the end plate of the other one of the first and second scrolls, the adjustment member including a deformable element which changes shape according to external input, only the first scroll being provided with the deformable element.

2. The scroll fluid machine of claim 1, wherein the deformable element is formed at a tip of at least one of the wraps and changes shape along a height of the wrap to adjust the amount of the space.

3. The scroll fluid machine of claim 1, wherein the deformable element is formed at a tip of at least one of the wraps to extend over a spiral of the wrap, and the deformable element changes length along the spiral of the wrap to adjust the amount of the space.

4. The scroll fluid machine of claim 3, wherein two or more deformable elements are formed along the spiral of the wrap.

5. The scroll fluid machine of claim 1, wherein the deformable element adjusts the amount of the space to vary a capacity.

6. The scroll fluid machine of claim 1, wherein the deformable element adjusts the amount of the space to vary an angle of rotation at which fluid discharge begins.

7. The scroll fluid machine of claim 1, wherein a working chamber is defined between the first scroll and the second scroll and a discharge port for discharging fluid from the working chamber is provided with a discharge valve, and the wrap is configured such that a capacity of the working chamber becomes substantially zero after discharging fluid is terminated.

8. The scroll fluid machine of claim 1, wherein the deformable element is provided at a tip of at least one of the wraps and also functions as a seal between the end plate and the wrap.

9. The scroll fluid machine of claim 1, wherein the deformable element is disposed in a recess formed at a tip of at least one of the wraps, and the recess is formed such that a wall of the recess including an inner circumference surface of the wrap has a thickness different from that of a wall of the recess including an outer circumference surface of the wrap.

10. The scroll fluid machine of claim 1, wherein the deformable element is made of a polymer actuator.

11. The scroll fluid machine of claim 1, wherein the deformable element is configured and arranged to extend from a bottom to a top of the spiral wrap of the first scroll.

12. The scroll fluid machine of claim 1, wherein the deformable element has a property of bending according to voltage application.

13. The scroll fluid machine of claim 1, wherein one of the spiral wraps is longer than the other of the spiral wraps.

* * * * *